US007080458B2

(12) United States Patent
Andis

(10) Patent No.: US 7,080,458 B2
(45) Date of Patent: Jul. 25, 2006

(54) CERAMIC MOVABLE BLADES FOR BLADE SETS OF HAIR CLIPPERS

(75) Inventor: Matthew L. Andis, Racine, WI (US)

(73) Assignee: Andis Company, Sturtevant, WI (US)

( * ) Notice: Subject to any disclaimer, the term of this patent is extended or adjusted under 35 U.S.C. 154(b) by 241 days.

(21) Appl. No.: 10/621,299

(22) Filed: Jul. 17, 2003

(65) Prior Publication Data

US 2005/0011076 A1 Jan. 20, 2005

(51) Int. Cl.
*B26B 19/00* (2006.01)

(52) U.S. Cl. ..... 30/223; 30/208; 30/210; 30/225

(58) Field of Classification Search ..... 30/223, 30/210, 208, 221, 209, 211, 222, 194, 196, 30/216, 225, 224, 200, 233.5, 355
See application file for complete search history.

(56) References Cited

U.S. PATENT DOCUMENTS

| | | | | | |
|---|---|---|---|---|---|
| 1,729,332 | A | * | 9/1929 | Dremel | 30/223 |
| 1,956,042 | A | | 4/1934 | Oster | |
| 2,098,180 | A | | 11/1937 | Dilks | |
| 2,182,597 | A | | 12/1939 | Oster | |
| 2,276,061 | A | * | 3/1942 | Oster | 30/211 |
| 2,484,610 | A | * | 10/1949 | Cromonic | 30/210 |
| 2,611,955 | A | * | 9/1952 | Brown et al. | 30/216 |
| 2,704,887 | A | | 3/1955 | Andis | |
| 2,928,171 | A | * | 3/1960 | Oster | 30/221 |
| 3,101,535 | A | | 8/1963 | Andis | |
| 3,222,781 | A | | 12/1965 | Luther et al. | |
| 3,222,782 | A | * | 12/1965 | Sadlon | 30/223 |
| 3,992,778 | A | | 11/1976 | Urbush | |
| 4,249,307 | A | | 2/1981 | Andis | |
| 4,328,616 | A | | 5/1982 | Andis | |
| 4,458,417 | A | | 7/1984 | Andis | |
| 4,563,814 | A | * | 1/1986 | Trichell et al. | 30/225 |
| 4,694,575 | A | | 9/1987 | Boerger | |
| 4,765,060 | A | | 8/1988 | Veselaski et al. | |
| 4,899,444 | A | * | 2/1990 | Trichell et al. | 30/208 |
| 4,989,324 | A | | 2/1991 | Andis | |
| 5,068,966 | A | | 12/1991 | Wahl et al. | |
| 5,088,200 | A | | 2/1992 | Piwaron et al. | |
| 5,230,153 | A | | 7/1993 | Andis | |
| 5,325,590 | A | | 7/1994 | Andis et al. | |

(Continued)

FOREIGN PATENT DOCUMENTS

JP 402142587 A * 5/1990

(Continued)

OTHER PUBLICATIONS

Sintered blade that was publicly available at least as early as May 2002 (see attached Statement of Relevance and FIGS. 1A and 1B).

(Continued)

*Primary Examiner*—Allan N. Shoap
*Assistant Examiner*—Ghassem Alie
(74) *Attorney, Agent, or Firm*—Michael Best & Friedrich LLP

(57) ABSTRACT

A blade set for a hair clipper including a movable blade constructed of ceramic. The movable blade includes an upper surface having a pair of integrally formed upper reinforcing protrusions. The upper reinforcing protrusions are disposed adjacent to a drive notch sized to receive a drive finger of the hair clipper. Reciprocation of the drive finger results in a cutting action of the blade set.

20 Claims, 5 Drawing Sheets

U.S. PATENT DOCUMENTS

| | | | | |
|---|---|---|---|---|
| 5,386,634 | A | 2/1995 | Ogle et al. | |
| 6,073,350 | A | 6/2000 | Elston et al. | |
| 6,421,922 | B1 * | 7/2002 | Beutel et al. | 30/216 |
| 6,473,973 | B1 | 11/2002 | Laube | |
| 6,505,404 | B1 | 1/2003 | Ullmann | |

FOREIGN PATENT DOCUMENTS

| | | | |
|---|---|---|---|
| JP | 40215491 | A * | 6/1990 |

OTHER PUBLICATIONS

Ceramic blade that was publicly available at least as early as May 2002 (see attached Statement of Relevance and FIGS. 2A and 2B).

Ceramic blade that was publicly available at least as early as May 2002 (see attached Statement of Relevance and FIGS. 3A and 3B).

* cited by examiner

CERAMIC MOVABLE BLADES FOR BLADE SETS OF HAIR CLIPPERS

BACKGROUND OF THE INVENTION

The invention relates generally to hair clippers, and more specifically to movable blades for blade sets of hair clippers.

Hair clippers typically include a blade set having a fixed lower blade and a movable or reciprocating upper blade. The movable blade is movable with respect to the fixed blade by a drive mechanism. Various movable blades have been used to facilitate hair cutting operations. Nevertheless, a new movable blade that extends the useful life of blade sets would be welcomed by those in the art.

SUMMARY OF THE INVENTION

Most prior art movable blades are formed of metal. Some prior art movable blades are formed of other materials such as plastic or ceramic. Although ceramic movable blades generally stay sharp longer and conduct less heat than metal blades, ceramic blades have also been found to be less durable than metal blades. During a hair cutting operation, numerous blade sets may be interchanged to provide different cut lengths. Prior art ceramic blades often break when the drive mechanism is being drivingly connected to the movable blade. The invention provides a ceramic movable blade that exhibits the desirable properties of prior art ceramic movable blades and also includes enhanced durability.

In one embodiment, the invention provides a blade set for a hair clipper. The hair clipper includes a drive mechanism that has a drive finger. The blade set includes a fixed lower blade and a ceramic movable upper blade. The fixed blade includes a forward edge with a series of teeth that extend there along. Upper and lower surfaces of the fixed blade extend from the forward edge of the fixed blade. The movable blade includes a forward edge with a series of teeth that extend there along. Upper and lower surfaces of the movable blade extend from the forward edge of the movable blade. The upper surface of the movable blade includes a pair of integrally formed upper reinforcing protrusions. The lower surface of the movable blade is supported by the upper surface of the fixed blade. The movable blade includes a drive notch sized to receive the drive finger for movement of the forward edge of the movable blade in relation to the forward edge of the fixed blade during operation of the hair clipper. The drive notch includes two laterally spaced walls that extend between the upper and lower surfaces of the movable blade. Each upper reinforcing protrusion is disposed adjacent a respective one of the laterally spaced walls.

In another embodiment, the invention provides a blade set for a hair clipper. The hair clipper includes a drive mechanism that has a drive finger. The blade set includes a fixed lower blade and a ceramic movable upper blade. The fixed blade includes a forward edge with a series of teeth that extend there along. Upper and lower surfaces of the fixed blade extend from the forward edge of the fixed blade. The movable blade includes a forward edge with a series of teeth that extend there along. Upper and lower surfaces of the movable blade extend from the forward edge of the movable blade. The upper surface of the movable blade includes a pair of integrally formed upper reinforcing protrusions. The lower surface of the movable blade is supported by the upper surface of the fixed blade and includes a pair of integrally formed lower reinforcing rims and a pair of recessed portions. Each recessed portion extends outwardly from one of the lower reinforcing rims. The movable blade includes a drive notch sized to receive the drive finger for movement of the forward edge of the movable blade in relation to the forward edge of the fixed blade during operation of the hair clipper. The drive notch includes two substantially parallel walls that extend between the upper and lower surfaces of the movable blade. Each upper reinforcing protrusion is disposed adjacent a respective one of the substantially parallel walls. Each lower reinforcing rim forms a portion of a respective one of the substantially parallel walls. The movable blade also includes a pair of lead-in walls that extend between the upper and lower surfaces of the movable blade. Each lead-in wall extends outwardly and rearwardly from a respective one of the substantially parallel walls to a rearward edge of the movable blade. Each upper reinforcing protrusion extends upwardly and outwardly from a respective one of the lead-in walls and the respective one of the substantially parallel walls from which the respective one of the lead-in walls extends outwardly and rearwardly.

In yet another embodiment, the invention provides a blade set for a hair clipper. The hair clipper includes a drive mechanism that has a drive finger. The blade set includes a fixed lower blade, a ceramic movable upper blade, and a bias member. The fixed blade includes a forward edge with a series of teeth that extend there along. Upper and lower surfaces of the fixed blade extend from the forward edge of the fixed blade. The movable blade includes a forward edge with a series of teeth that extend there along. Upper and lower surfaces of the movable blade extend from the forward edge of the movable blade. The upper surface of the movable blade includes a pair of integrally formed upper reinforcing protrusions. The lower surface of the movable blade is supported by the upper surface of the fixed blade and includes a pair of integrally formed lower reinforcing rims and a pair of recessed portions. Each recessed portion extends outwardly from one of the lower reinforcing rims. The movable blade includes a drive notch sized to receive the drive finger for movement of the forward edge of the movable blade in relation to the forward edge of the fixed blade during operation of the hair clipper. The drive notch includes two substantially parallel walls that extend between the upper and lower surfaces of the movable blade. Each upper reinforcing protrusion is disposed adjacent a respective one of the substantially parallel walls. Each lower reinforcing rim forms a portion of a respective one of the substantially parallel walls. The movable blade also includes a pair of lead-in walls that extend between the upper and lower surfaces of the movable blade. Each lead-in wall extends outwardly and rearwardly from a respective one of the substantially parallel walls to a rearward edge of the movable blade. Each upper reinforcing protrusion extends upwardly and outwardly from a respective one of the lead-in walls and the respective one of the substantially parallel walls from which the respective one of the lead-in walls extends outwardly and rearwardly. The movable blade includes a groove that extends substantially parallel to the forward edge of the movable blade and includes chamfered ends. The bias member engages the groove to bias the movable blade against the fixed blade when the bias member is positioned against the upper surface of the movable blade. The chamfered ends are configured to direct the bias member toward the groove during assembly of the blade set.

Further objects of the present invention together with the organization and manner of operation thereof, will become apparent from the following detailed description of the invention when taken in conjunction with the accompanying drawings wherein like elements have like numerals throughout the drawings.

BRIEF DESCRIPTION OF THE DRAWINGS

The present invention is further described with reference to the accompanying drawings, which show an embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings. Additionally, unless specified or limited otherwise, the terms "top," "bottom," "upper," "lower," "forward," "rearward," "outward," "inward," "sideward," "downward," and "upward" and variations thereof as used herein are not meant to indicate a particular direction, but rather a relative direction with respect to the context of the discussion.

DETAILED DESCRIPTION

Figure 1:
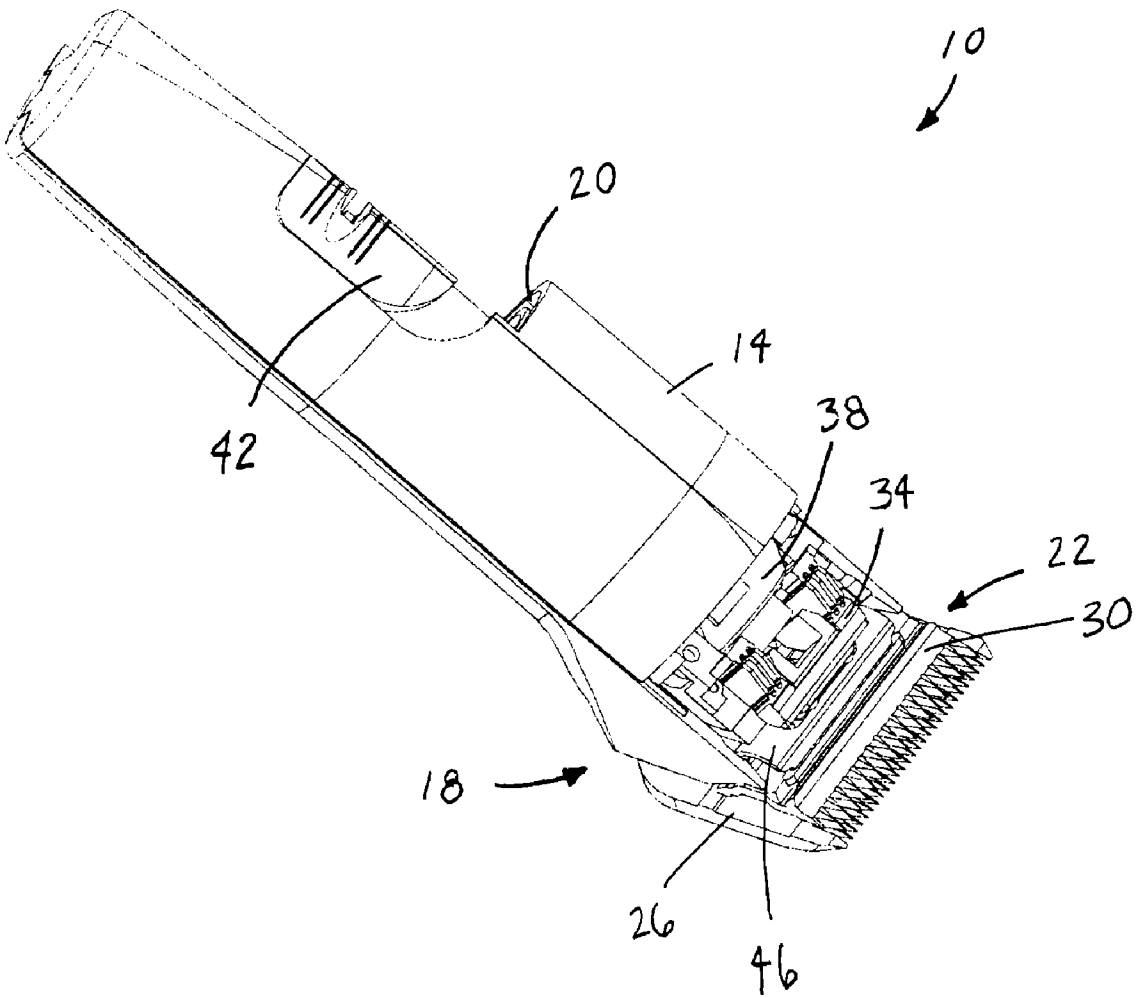
FIG. 1 is a perspective view of hair clipper with portions removed, the hair clipper including a blade set according to the invention.

Shown in the drawings is an electrical hair clipper or trimmer 10. The hair clipper 10 includes a hollow, elongated housing 14 having a cutting end 18. The illustrated housing 14 is constructed of an electrically insulating material, such as plastic, and includes two sections or parts which are connected together to define an inner cavity 20. The housing 14 may be alternatively constructed using any suitable design or material.

Figure 2:
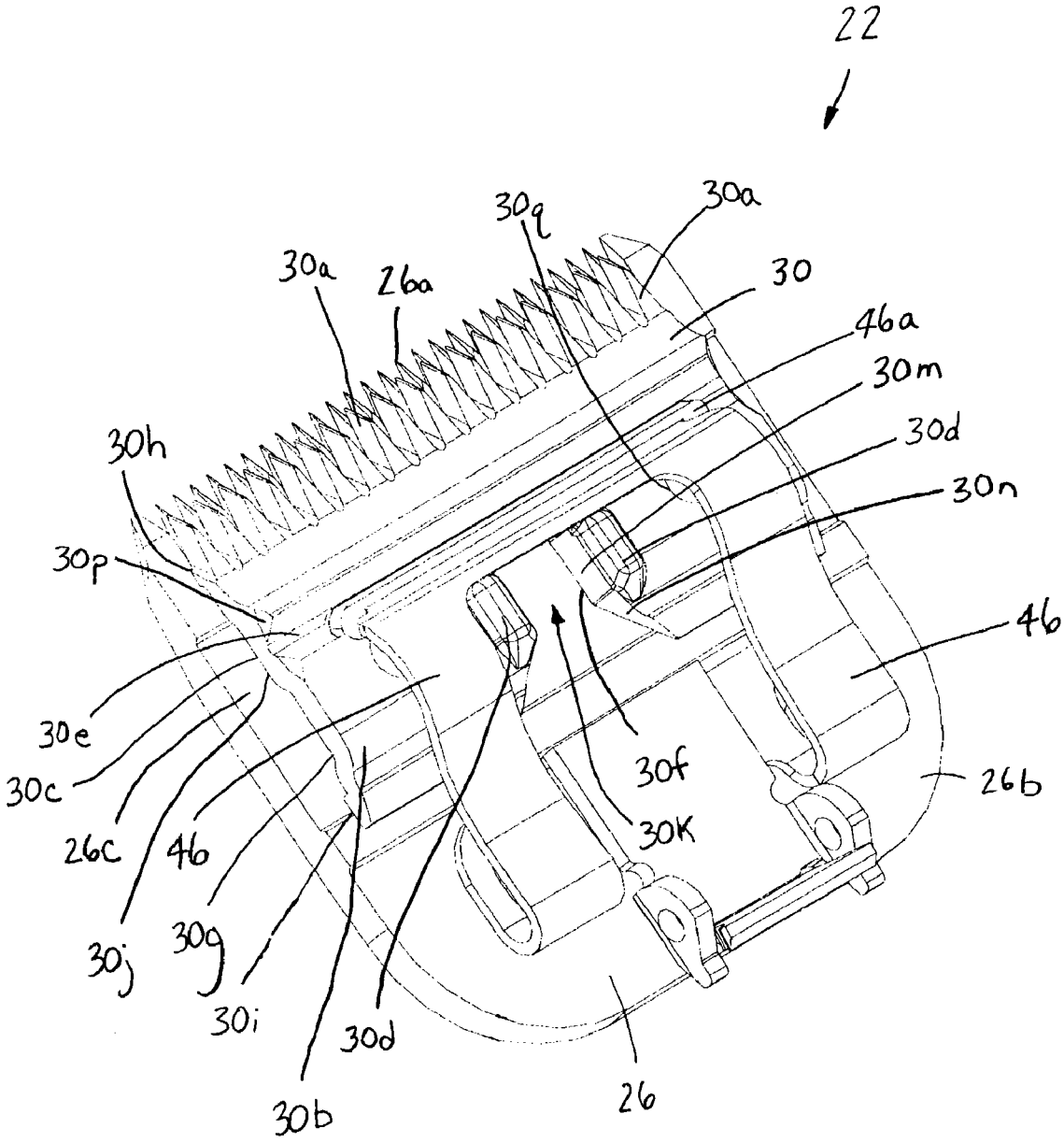
FIG. 2 is perspective view of the blade set shown in FIG. 1.

A blade set 22 according to the present invention supported on the cutting end 18 includes a fixed lower blade or shear plate 26. As illustrated in FIG. 2, the fixed blade 26 includes a forward edge with a series of teeth 26*a* extending there along. The fixed blade 26 also includes an upper surface 26*b* and an outer or lower surface (hidden from view in FIG. 2), each extending from the forward edge.

Referring again to FIG. 1, the blade set 22 also includes a movable or reciprocating upper blade 30. The illustrated movable blade member 30 is formed of a ceramic material. The movable blade 30 is movable with respect to the fixed blade 26 by a drive mechanism 34. An electric motor or actuator 38 is mounted in the inner cavity 20 and is drivingly connected to the blade set 22 by the drive mechanism 34. The motor 38 effects reciprocation of the movable blade 30 with respect to the fixed blade 26 in response to actuation of the motor 38. A user actuates the motor 38 using a power switch 42 provided on the housing 14. The switch 42 is configured to interrupt the flow of electrical power from a power supply to the motor 38. The electrical power may include an alternating current (AC) power and/or a direct current (DC) power. Hair clippers powered by AC power and/or DC power are generally known in the art and, accordingly, are not discussed further herein. As the hair clipper 10 is guided through a person's or an animal's hair, the reciprocating motion of the blade set 22 cuts the hair. A number of suitable actuators and driving arrangements are known. It should be appreciated that hair clippers having other types of actuators and/or driving arrangements would be suitable for use in combination with the present invention.

Referring to FIGS. 3–7, the movable blade 30 includes a forward edge with a series of teeth 30*a* extending there along. The movable blade 30 also includes an upper surface 30*b* (FIGS. 3 and 5) and a lower surface 30*c* (FIGS. 4 and 7), each extending from the forward edge of the movable blade 30.

The upper surface 30*b* includes a pair of integrally formed upper reinforcing protrusions or projections 30*d* and a groove 30*e*. The upper reinforcing protrusions 30*d* are laterally spaced and extend in a direction substantially perpendicular to the forward edge of the movable blade 30. The groove 30*e* extends substantially parallel to the forward edge of the movable blade 30.

Figure 4:
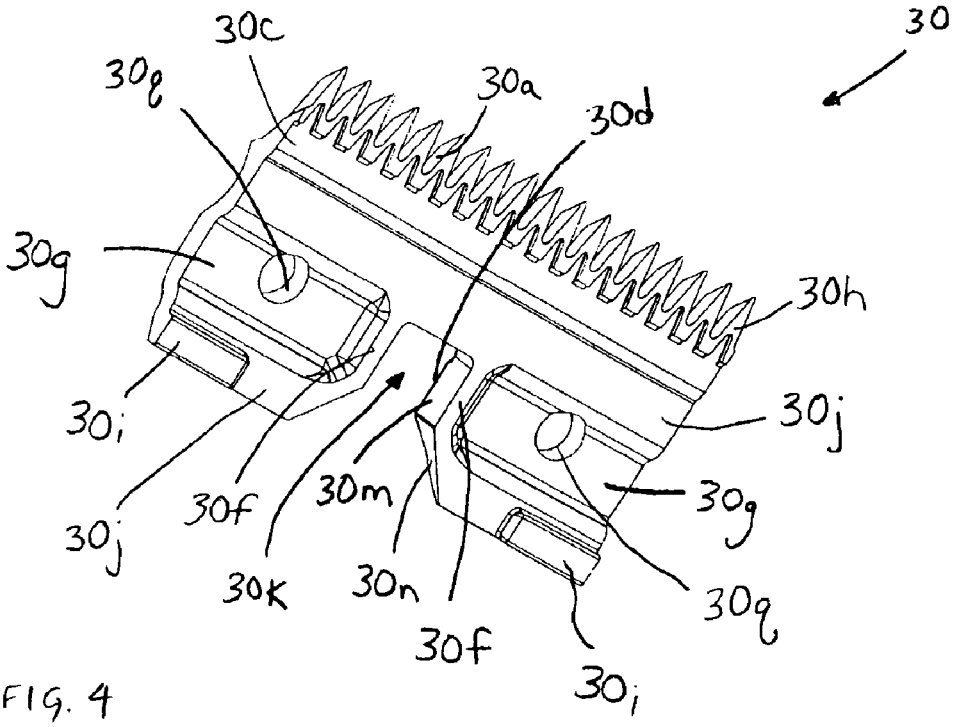
FIG. 4 is a lower perspective view of the ceramic movable blade shown in FIG. 3.

The lower surface 30*c* is supported by the upper surface 26*b* of the fixed blade 26 and includes a pair of integrally formed lower reinforcing rims 30*f* and a pair of shallow grooves or recesses 30*g*. The lower reinforcing rims 30*f* are laterally spaced and extend in a direction substantially perpendicular to the forward edge of the movable blade 30. Each recess 30*g* extends outwardly from a respective one of the lower reinforcing rims 30*f* in a direction generally parallel to the forward edge of the movable blade 30. As best illustrated in FIG. 4, the illustrated recesses 30*g* extend to a sideward edge of the moveable blade 30. The lower surface 30*c* also includes a forward wear surface 30*h* and rearward wear surfaces 30*i*. The wear surfaces 30*h* and 30*i* extend downwardly to bear against and space the remainder of the movable blade 30 from the upper surface 26*b* of the fixed blade 26. The upper surface 26*b* of fixed blade 26 includes a transverse recess 26*c* that cooperates with the wear surfaces 30*h* and 30*i* to operatively space the fixed and movable blades 26 and 30, thereby facilitating mating engagement of the teeth 26*a* and 30*a*.

Figure 7:
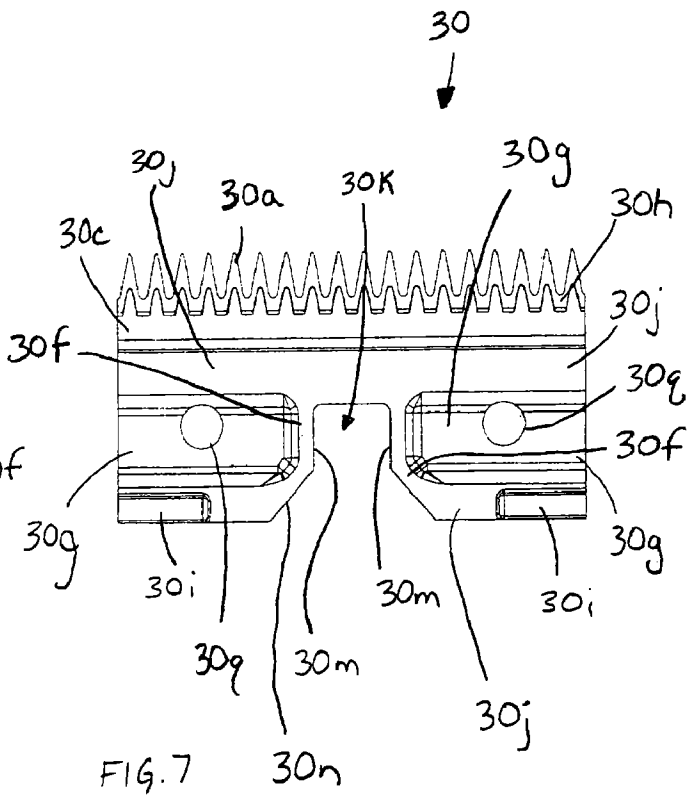
FIG. 7 is a bottom view of the ceramic movable blade shown in FIG. 3.
Figure 6:
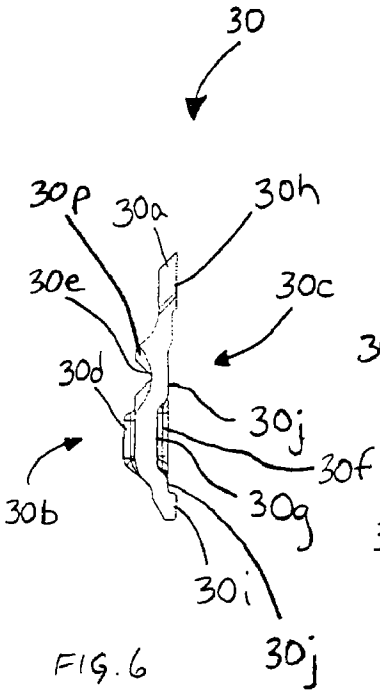
FIG. 6 is a side view of the ceramic movable blade shown in FIG. 3

The illustrated lower surface 30*c* includes a planar surface 30*j* defined by portions disposed forwardly, inwardly, and rearwardly of each recess 30*g*. As illustrated in FIGS. 4 and 7, the rearward wear surfaces 30*i* project out from the planar surface 30*j* and the lower reinforcing rims 30*f* each form a portion of the planar surface 30*j*. In other embodiments, the lower surface 30*c* may be alternatively shaped.

Figure 5:
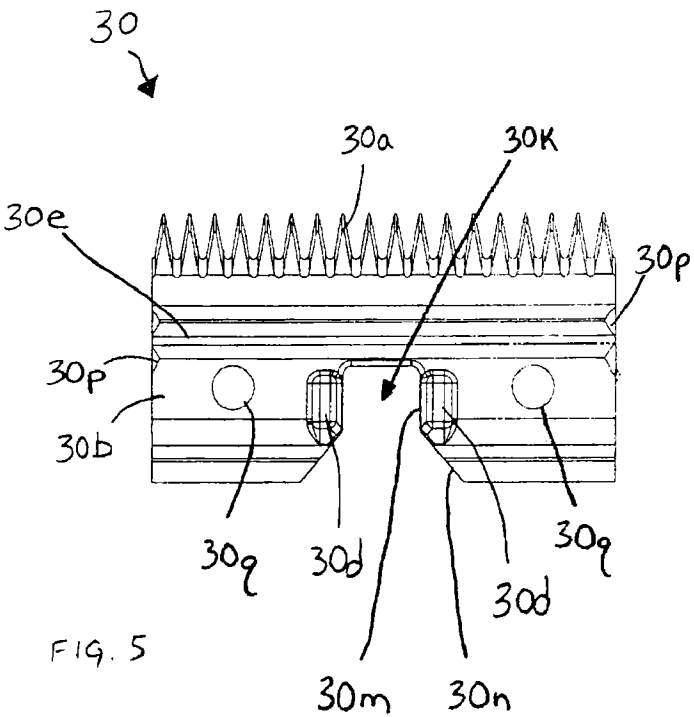
FIG. 5 is a top view of the ceramic movable blade shown in FIG. 3.

The movable blade 30 includes a drive notch or slot 30*k* sized to receive a drive finger 34*a* of the drive mechanism 34 for movement of the forward edge of the movable blade 30 in relation to the forward edge of the fixed blade 26 during operation of the hair clipper 10. The illustrated drive notch 30*k* is generally U-shaped and includes two laterally spaced walls 30*m* that extend between the upper and lower surfaces 30*b* and 30*c*. As illustrated in FIG. 5, the walls 30*m* extend in a direction substantially perpendicular to the forward edge of the movable blade 30. The illustrated walls 30*m* are substantially parallel. The drive notch 30*k* may be alternatively sized and shaped in other embodiments.

Figure 3:
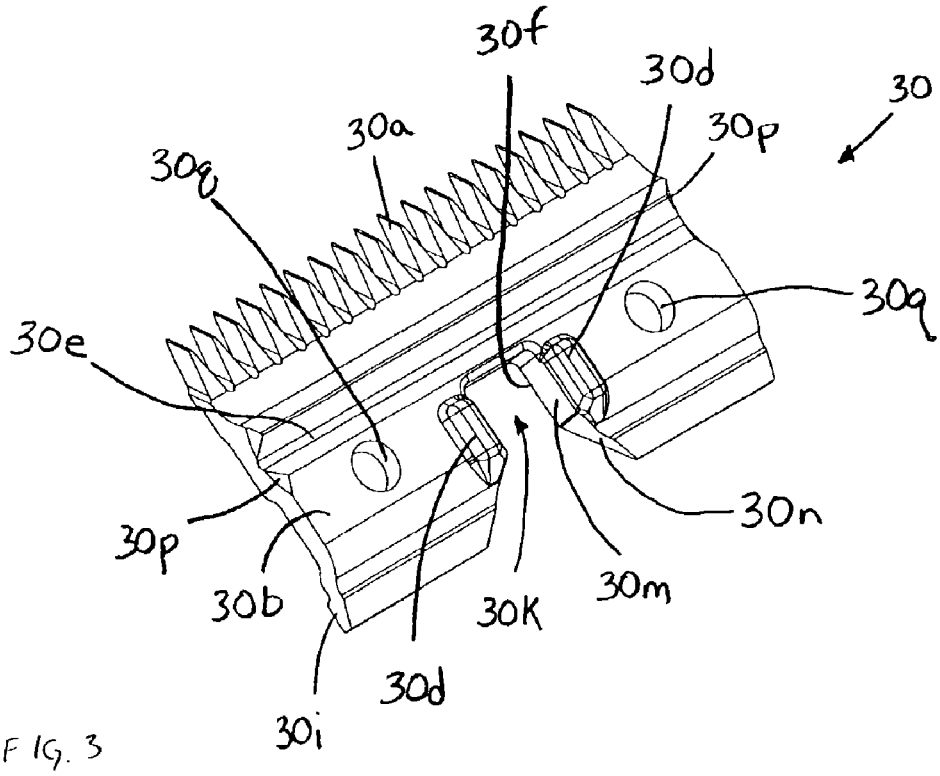
FIG. 3 is an upper perspective view of a ceramic movable blade of the blade set shown in FIG. 2.

Each upper reinforcing protrusion 30*d* is disposed adjacent a respective one of the walls 30*m*. The upper reinforcing protrusions 30*d* provide structural support to the movable blade 30. This structural support enhances durability of the movable blade 30 in comparison to prior art ceramic movable blades, especially when the drive mechanism 34 is being drivingly connected to the movable blade 30. As illustrated in FIGS. 3 and 5, each upper reinforcing protrusion 30*d* includes an upper reinforcing protrusion lead-in surface that extends upwardly and outwardly from the drive notch 30*k*. The upper reinforcing protrusion lead-in surfaces direct the drive finger 34*a* toward the drive notch 30*k* when the drive mechanism 34 is being drivingly connected to the movable blade 30. The upper reinforcing protrusions 30*d* may include alternative shapes and sizes in other embodiments.

Figure 8:
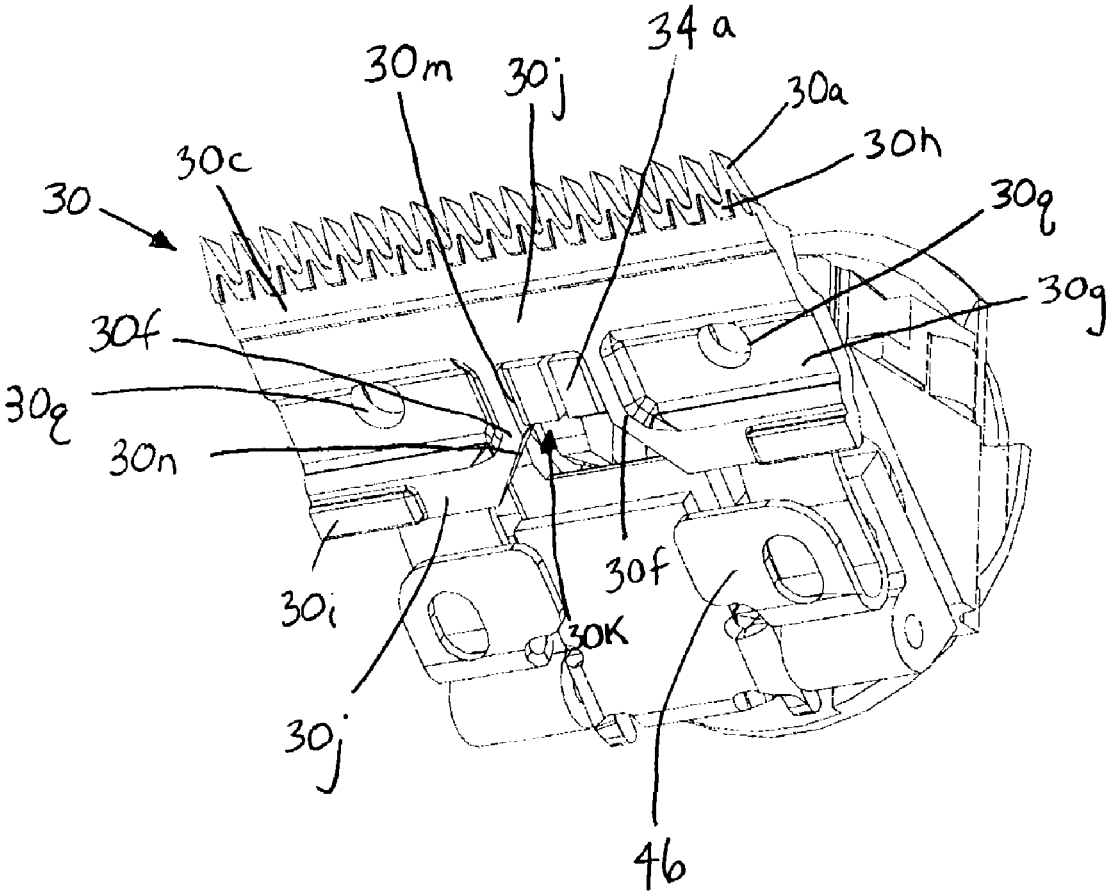
FIG. 8 is perspective view showing a drive finger of the hair clipper shown in FIG. 1 drivingly engaging a drive notch of the movable blade shown in FIG. 3

Each lower reinforcing rim 30*f* forms a portion of a respective one of the walls 30*m*. As illustrated in FIG. 8, the drive finger 34*a* engages the walls 30*m* to cause transverse reciprocating movement of the movable blade 30 with respect to the fixed blade 26 during operation of the hair clipper 10. The lower reinforcing rims 30*f* form a portion of the bearing area for the drive finger 34*a*. The enlarged bearing area, as compared to if there were no reinforcing rim 30*f*, reduces wear of the drive notch 30*k* and the drive finger 34*a*, thus extending the useful life of the movable blade 30 and the drive mechanism 34. The enlarged bearing area also reduces noise generated during operation of the hair trimmer 10.

The movable blade 30 also includes lead-in walls 30*n* that extend between the upper and lower surfaces 30*b* and 30*c*. As illustrated in FIG. 5, each wall 30*n* extends from a respective one of the walls 30*m* in a direction rearwardly and outwardly from the drive notch 30*k*. Each upper reinforcing protrusion 30*d* is disposed adjacent a portion of a respective one of the walls 30*n*. As illustrated in FIGS. 3 and 5, the lead-in surface of each upper reinforcing protrusion 30*d* extends upwardly and outwardly from a portion of the respective one of the walls 30*n*. Each lower reinforcing rim 30*f* forms a portion of a respective one of the lead-in walls 30*n*. The lead-in walls 30*n* direct the drive finger 34*a* toward the drive notch 30*k* when the drive mechanism 34 is being drivingly connected to the movable blade 30.

As best seen in FIGS. 2 and 8, the blade set 22 also includes a bias member 46. The movable blade 30 is biased against the upper surface 26*b* of the fixed blade 26 by the bias member 46. The bias member 46 supports the movable blade 30 for reciprocating movement in a path generally parallel to the forward edge of the fixed blade 26. A forward edge of the bias member 46 is positioned in the groove 30*e* and includes a cover 46*a*. The illustrated cover 46*a* has a low coefficient of friction that facilitates reciprocal movement of the movable blade 30.

The movable blade 30 can be removed from the blade set 22 for cleaning, sharpening, or replacement by moving the movable blade 30 laterally from between the fixed blade 26 and the bias member 46. The bias member 46 allows for accurate realignment of the movable blade 30 with respect to the fixed blade 26 when the movable blade 30 is replaced. The groove 30*e* includes chamfered ends 30*p*. The chamfered ends 30*p* direct the bias member 46 toward the groove 30*e* when coupling the movable blade 30 to the remainder of the blade set 22. The chamfered ends 30*p* also reduce damage to the cover 46*a* during such assembly.

The movable blade 30 also includes a pair of apertures 30*q* that extend between the upper and lower surfaces 30*b* and 30*c*. Each illustrated aperture 30*q* extends through a portion of a respective one of the recesses 30*g*. The apertures 30*q* and the recesses 30*g* reduce the amount of ceramic material necessary to form the movable blade 30 without compromising the strength and durability of the movable blade 30.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

What is claimed is:

1. A blade set for a hair clipper, the hair clipper including a drive mechanism having a drive finger, the blade set comprising:

a fixed lower blade including a forward edge with a series of teeth extending there along, an upper surface, and a lower surface; and a movable upper blade including a forward edge with a series of teeth extending there along, a rearward edge, an upper surface including a pair of upper reinforcing protrusions extending upwardly from the upper surface, a generally planar lower surface extending rearward of the forward edge, the lower surface being supported by the upper surface of the fixed blade, the lower surface defining a pair of lower reinforcing rims co-planar with the lower surface and including a pair of recessed portions, each recessed portion extending outwardly from a respective one of the lower reinforcing rims and being recessed from the lower surface, a drive notch sized to receive the drive finger for movement of the movable blade in relation to the fixed blade during operation of the hair clipper, the drive notch including two substantially parallel walls extending between the upper and lower surfaces of the movable blade, each upper reinforcing protrusion being disposed adjacent a respective one of the substantially parallel walls and each lower reinforcing rim forming a portion of a respective one of the substantially parallel walls, and a pair of lead-in walls extending between the upper and lower surface of the movable blade, each lead-in wall extending outwardly and rearwardly from a respective one of the substantially parallel walls to the rearward edge, each upper reinforcing protrusion extending upwardly and outwardly from a respective one of the lead-in walls and the respective one of the substantially parallel walls from which the respective one of the lead-in walls extends outwardly and rearwardly.

2. A blade set according to claim 1 wherein the movable upper blade is constructed of ceramic.

3. A blade set according to claim 1 wherein each upper reinforcing protrusion is configured to direct the drive finger toward the drive notch when the drive finger is being drivingly connected to the movable blade.

4. A blade set according to claim 1 wherein each recessed portion extends outwardly from the respective one of the lower reinforcing rims to a respective one of a pair of sideward edges of the movable blade.

5. A blade set according to claim 1 wherein the lower surface of the moveable blade includes first, second, and third portions disposed adjacent a respective one of the recessed portions and co-planar with the lower surface, wherein the first portion extends forwardly from the respective one of the recessed portions, wherein the second portion extends inwardly from the respective one of the recessed portions, wherein the third portion extends rearwardly from the respective one of the recessed portions.

6. A blade set according to claim 5, wherein the second portion at least partially defines the respective one of the lower reinforcing rims from which the respective one of the recessed portions extends outwardly.

7. A blade set according to claim 5, wherein the third portion at least partially defines the respective one of the lower reinforcing rims from which the respective one of the recessed portions extends outwardly.

8. A blade set according to claim 1 wherein the lower surface of the movable blade includes at least one wear surface disposed proximate the rearward edge and extending downwardly and outwardly from the lower surface, wherein the at least one wear surface directly engages the upper surface of the lower blade and spaces at least a portion of the lower surface of the movable blade from the upper surface of the fixed blade.

9. A blade set according to claim 1 wherein each lead-in wall is configured to direct the drive finger toward the drive notch when the drive finger is being drivingly connected to the movable blade.

10. A blade set according to claim 1 and further comprising a bias member positionable against the upper surface of the movable blade to bias the movable blade against the fixed blade, wherein the movable blade includes a groove extending substantially parallel to the forward edge of the movable blade, and wherein the bias member engages the groove when positioned against the upper surface of the movable blade.

11. A blade set according to claim 10 wherein the groove includes chamfered ends, and wherein the chamfered ends direct the bias member toward the groove during assembly of the blade set.

12. A blade set according to claim 1 wherein each of the substantially parallel walls extends in a direction substantially perpendicular to the forward edge of the movable blade.

13. A blade set for a hair clipper, the hair clipper including a drive mechanism having a drive finger, the blade set comprising:

a bias member;

a fixed lower blade including a forward edge with a series of teeth extending there along, an upper surface, and a lower surface; and a movable upper blade including a forward edge with a series of teeth extending there along, a rearward edge, an upper surface including a pair of upper reinforcing protrusions extending upwardly from the upper surface, a generally planar lower surface extending rearward of the forward edge, the lower surface being supported by the upper surface of the fixed blade, the lower surface defining a pair of lower reinforcing rims co-planar with the lower surface and including a pair of recessed portions, each recessed portion extending outwardly from a respective one of the lower reinforcing rims and being recessed from the lower surface, a drive notch sized to receive the drive finger for movement of the movable blade in relation to the fixed blade during operation of the hair clipper, the drive notch including two substantially parallel walls extending between the upper and lower surfaces of the movable blade, each upper reinforcing protrusion being disposed adjacent a respective one of the substantially parallel walls and each lower reinforcing rim forming a portion of a respective one of the substantially parallel walls, a pair of lead-in walls extending between the upper and lower surface of the movable blade, each lead-in wall extending outwardly and rearwardly from a respective one of the substantially parallel walls to the rearward edge, each upper reinforcing protrusion extending upwardly and outwardly from a respective one of the lead-in walls and the respective one of the substantially parallel walls from which the respective one of the lead-in walls extends outwardly and rearwardly, and a groove extending substantially parallel to the forward edge of the movable blade and including chamfered ends, the bias member engaging the groove to bias the movable blade against the fixed blade when the bias member is positioned against the upper surface of the movable blade, the chamfered ends being configured to direct the bias member toward the groove during assembly of the blade set.

14. A blade set according to claim 13 wherein the movable upper blade is constructed of ceramic.

15. An upper blade for a blade set used with a hair clipper, the upper blade comprising:

a body portion;

a forward edge with a series of teeth extending there along, a rearward edge, an upper surface including a pair of upper reinforcing protrusions extending upwardly from the upper surface, a generally planar lower surface extending rearward of the forward edge, the lower surface defining a pair of lower reinforcing rims co-planar with the lower surface and including a pair of recessed portions, each recessed portion extending outwardly from a respective one of the lower reinforcing rims and being recessed from the lower surface, a drive notch sized including two substantially parallel walls extending between the upper and lower surfaces, each upper reinforcing protrusion being disposed adjacent a respective one of the substantially parallel walls and each lower reinforcing rim forming a portion of a respective one of the substantially parallel walls, and a pair of lead-in walls extending between the upper and lower surface, each lead-in wall extending outwardly and rearwardly from a respective one of the substantially parallel walls to the rearward edge, each upper reinforcing protrusion extending upwardly and outwardly from a respective one of the lead-in walls and the respective one of the substantially parallel walls from which the respective one of the lead-in walls extends outwardly and rearwardly.

16. An upper blade according to claim 15 wherein the body portion is constructed of ceramic.

17. An upper blade according to claim 15 wherein each recessed portion extends outwardly from the respective one of the lower reinforcing rims to a respective one of a pair of sideward edges of the movable blade.

18. An upper blade according to claim 15 wherein the lower surface includes at least one wear surface disposed proximate the rearward edge and extending downwardly and outwardly from the lower surface.

19. An upper blade according to claim 15 wherein the upper surface includes a groove extending substantially parallel to the forward edge.

20. An upper blade according to claim 15 wherein each of the substantially parallel walls extends in a direction substantially perpendicular to the forward edge.

* * * * *